US008523409B1

(12) United States Patent
Drake et al.

(10) Patent No.: US 8,523,409 B1
(45) Date of Patent: Sep. 3, 2013

(54) FEATURES FOR RECESSED LIGHTING FIXTURES

(75) Inventors: George Michael Drake, Newnan, GA (US); Robert Allan Blalock, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 376 days.

(21) Appl. No.: 13/007,404

(22) Filed: Jan. 14, 2011

Related U.S. Application Data

(60) Provisional application No. 61/295,044, filed on Jan. 14, 2010.

(51) Int. Cl.
*F21V 15/01* (2006.01)
*F21V 29/00* (2006.01)

(52) U.S. Cl.
USPC ..... 362/373; 362/364; 362/365; 362/294

(58) Field of Classification Search
USPC ..... 362/364, 365, 366, 373, 294, 147–150, 362/547, 218, 396, 368, 391
See application file for complete search history.

(56) References Cited

U.S. PATENT DOCUMENTS

| | | | | |
|---|---|---|---|---|
| 3,721,817 | A * | 3/1973 | Contratto | 362/365 |
| 5,124,901 | A * | 6/1992 | Sojka et al. | 362/366 |
| 5,826,970 | A | 10/1998 | Keller et al. | |
| 5,957,574 | A * | 9/1999 | Hentz et al. | 362/365 |
| 6,431,723 | B1 | 8/2002 | Schubert et al. | |
| 7,722,227 | B2 * | 5/2010 | Zhang et al. | 362/364 |
| 7,993,034 | B2 * | 8/2011 | Wegner | 362/296.05 |
| 8,042,973 | B2 | 10/2011 | Inoue et al. | |
| 8,070,328 | B1 | 12/2011 | Knoble et al. | |
| 8,096,670 | B2 | 1/2012 | Trott et al. | |
| 8,182,116 | B2 * | 5/2012 | Zhang et al. | 362/294 |
| 8,220,970 | B1 | 7/2012 | Khazi et al. | |
| 8,287,142 | B2 * | 10/2012 | Pickard et al. | 362/148 |
| 2003/0053315 | A1 | 3/2003 | Chen | |
| 2005/0168986 | A1 | 8/2005 | Wegner | |
| 2005/0254241 | A1 | 11/2005 | Harwood | |
| 2007/0097693 | A1 | 5/2007 | Klose | |
| 2008/0084701 | A1 | 4/2008 | Van de Ven et al. | |
| 2008/0165535 | A1 | 7/2008 | Mazzochette | |
| 2009/0129086 | A1 * | 5/2009 | Thompson, III | 362/249.02 |
| 2009/0231862 | A1 * | 9/2009 | Seo | 362/365 |
| 2010/0188838 | A1 | 7/2010 | Yajima et al. | |

OTHER PUBLICATIONS

Juno Lighting Group, Indy J3.1.19, Product Specifications, 6" Square PAR38 Internally Adjustable, Aug. 2009.

(Continued)

*Primary Examiner* — Bao Q Truong
(74) *Attorney, Agent, or Firm* — King & Spalding LLP

(57) ABSTRACT

Improved installation features for recessed light fixtures including downlights are provided. The recessed light fixture includes a housing and a lighting module removably attachable to the housing. The lighting module includes a flexible conduit connector that provides a pathway for electrical connections from outside the lighting module to access the inner portion of the lighting module. The conduit connector is disposed on an angled surface that improves the ease of installation and removal of the lighting module and reduces the required installation space of the recessed light fixture. The housing includes improved torsion spring receivers having angled edges for guiding the torsion spring into the proper position. The torsion spring receivers also include retaining tabs having a curved edge that better holds the torsion spring in place and also provides additional clearance for installing and removing the lighting module.

19 Claims, 5 Drawing Sheets

(56) References Cited

OTHER PUBLICATIONS

Prescolite, LiteFrame LED, LiteFrame 6" LED downlight; Product Specification, Sep. 2010.
Philips Lighting, Product Specification, eW Downlight Powercore, Feb. 2010.
Renaissance Lighting, Product Specification, Solia 4" White Downlight Square, Oct. 2010.
International Search Report issued for PCT/US2011/021390 mailed on Aug. 31, 2011.0.

* cited by examiner

FEATURES FOR RECESSED LIGHTING FIXTURES

RELATED PATENT APPLICATIONS

This patent application claims priority under 35 U.S.C. §119 to U.S. Provisional Patent Application No. 61/295,044, titled "Features for Improving Installation and Light Output for LED Lighting Fixtures" and filed Jan. 14, 2010, the complete disclosure of which is hereby fully incorporated herein by reference.

TECHNICAL FIELD

Embodiments of the invention relate generally to lighting fixtures, and more particularly to features that improve the installation of lighting modules or trims with recessed light fixture housings.

BACKGROUND

Recessed lights, such as downlights, are light systems or light fixtures that are installed in a hollow opening within a ceiling, wall, or other structure. The recessed light generally includes a housing mounted in the ceiling and a lighting module removably attachable to the housing. The lighting module generally includes a light source, such as one or more light emitting diodes ("LEDs"), compact fluorescent lamps ("CFLs"), high-intensity discharge ("HID") lamps, or incandescent lamps. When installed in the housing and powered on, the light source provides inconspicuous light that appears to shine from a hole in the ceiling or other structure where the recessed light is installed.

Housings for recessed lights typically include a lamp holder for holding the lighting module in place. Some conventional lamp holders employ torsion spring retainers that accept torsion springs attached to the light source. When in place in the torsion spring retainers, the torsion springs hold the lighting module in place in the housing. The torsion springs also interact with the torsion spring retainers to pull the lighting module into the housing during installation. However, the installation of lighting modules using conventional torsion springs can be clumsy and difficult for users. The design of conventional torsion spring retainers also makes the torsion springs more susceptible to slipping from the torsion spring retainers.

Lighting modules for recessed lights typically include an electrical connector that attaches to an electrical connector of the housing to receive power for the light source. This electrical connector of conventional lighting modules is often mounted in a vertical orientation on top of or above the lighting module's heat sink, adding height to the lighting module. The added height increases the required installation space for the recessed light. In addition, the vertical orientation of the electrical connector causes flexible conduits or cables connected to the electrical connector to extend higher above the lighting module before turning in a horizontal direction due to the required bend radius of the flexible conduit or cable. The position and vertical orientation of electrical connectors for conventional lighting modules also make it more difficult to connect the lighting module's electrical connector to the housing's electrical connector.

SUMMARY

The present invention provides improved features for installing lighting modules with recessed light fixture housings. The housing can include one or more torsion spring receivers for accepting and holding in place torsion springs coupled to the lighting module. The torsion spring receivers can include a backstop and torsion spring brackets having edges angled with respect to backstop. The angled edges can each guide a portion of a torsion spring into position in a respective hook slot formed by a retaining tab. The retaining tab can be curved to follow the profile of the lighting module's heat sink providing space for the heat sink during installation and removal of the lighting module.

The lighting module can include a flexible conduit connector for receiving a flexible conduit. The flexible conduit connector can include an aperture for routing electrical conductors between the outside of the lighting module and the inner portion of the lighting module. The flexible conduit connector can be disposed on an angled surface of the lighting module above the lighting module's light source and opposite the light source's direction of illumination. The surface can be angled in one or more directions to allow the flexible conduit to lay flatter when the lighting module is installed in the housing and reduce the required installation space for the housing.

For one aspect of the present invention, a lighting module can include a first surface having a first side and an opposing second side. A light source can be disposed along the first side. A heat sink can be disposed on the second side and opposite a direction of illumination for the light source. A flexible conduit connector can be disposed at an acute angle along at least one axis and disposed along the first surface. The flexible conduit connector can provide an aperture through the first surface for receiving electrical wiring for the light source.

For another aspect of the invention, a light fixture can include a housing for receiving and holding a lighting module having a light source. The light fixture also can include a torsion spring receiver coupled to the housing. The torsion spring receiver can include a backstop having a substantially straight edge, a first torsion spring bracket disposed on a first side of the backstop, and a second torsion spring bracket disposed on the first side of the backstop. The first torsion spring bracket can receive a first portion of a torsion spring. The first torsion spring bracket can include a first inner edge extending out orthogonally from the straight edge and curving to extend further from the straight edge at a first acute angle with respect to the straight edge. The first torsion spring bracket also can include a first retaining tab having a first curved edge that extends from the end of the first inner edge opposite the straight edge to form a first area for receiving the first portion. The second torsion spring bracket can receive a second portion of the torsion spring. The second torsion spring bracket can include a second inner edge extending out orthogonally from the straight edge and curving to extend further from the straight edge at a second acute angle with respect to the straight edge. The second torsion spring bracket also can include a second retaining tab having a second curved edge that extends from the end of the second inner edge opposite the straight edge to form a second area for receiving the second portion.

For yet another aspect of the present invention, a downlight luminaire can include a housing for receiving and holding a lighting module having a light source. The downlight luminaire also can include at least one torsion spring receiver coupled to the housing. Each torsion spring receiver can include, a backstop having a substantially straight edge, a first torsion spring receiver portion disposed on a first side of the backstop and a second torsion spring receiver portion disposed on the first side. The first torsion spring portion can include a first edge that extends at a first acute angle from the straight edge to a first inner hook-shaped edge. The first torsion spring receiver portion can receive a first portion of a torsion spring of the lighting module. The second torsion spring receiver portion can include a second edge that extends at a second acute angle from the straight edge to second inner hook-shaped edge. The second torsion spring receiver portion can receive a second portion of the torsion spring.

For yet another aspect of the present invention, a light fixture can include a housing for receiving and holding a lighting module having a light source. At least one torsion spring receiver can be coupled to the housing. Each torsion spring receiver can include a backstop having a substantially straight edge. A first torsion spring receiver portion can be disposed on a first side of the backstop and include a first edge that extends from the straight edge to a first inner hook-shaped edge. The first torsion spring receiver portion can receive a first portion of a torsion spring of the lighting module. A second torsion spring receiver portion can be disposed on the first side and include a second edge that extends from the straight edge to second inner hook-shaped edge. The second torsion spring receiver portion can receive a second portion of the torsion spring. The first hook-shaped edge can be positioned at a greater distance orthogonally from the substantially straight edge than the second hook-shaped edge.

These and other aspects, features, and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the exemplary embodiments of the present invention and the advantages thereof, reference is now made to the following description in conjunction with the accompanying drawings in which.

Figure 1:
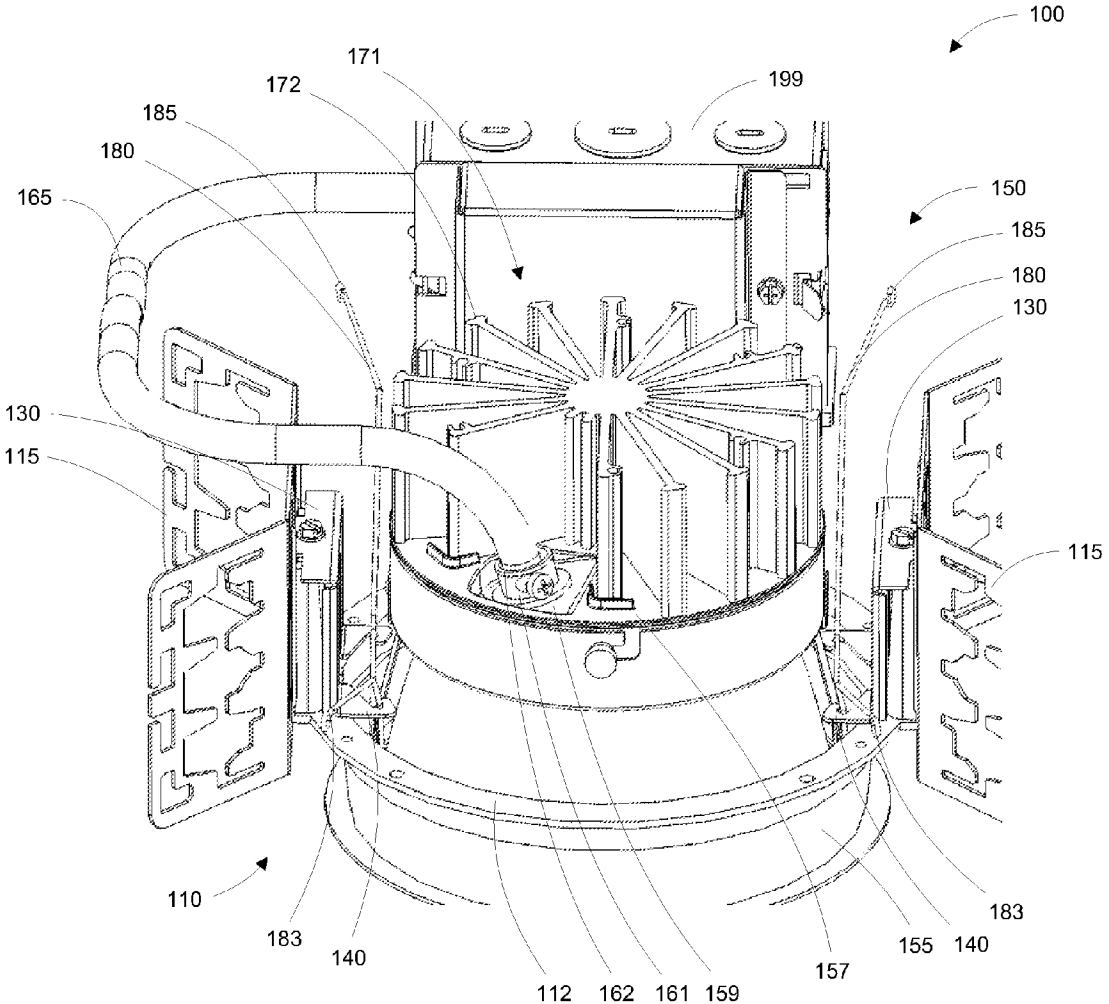
FIG. 1 is a partial perspective view of a recessed light having a housing and a lighting module, in accordance with certain exemplary embodiments.

The drawings illustrate only exemplary embodiments of the invention and are therefore not to be considered limiting of its scope, as the invention may admit to other equally effective embodiments. The elements and features shown in the drawings are not necessarily to scale, emphasis instead being placed upon clearly illustrating the principles of exemplary embodiments of the present invention. Additionally, certain dimensions may be exaggerated to help visually convey such principles.

DETAILED DESCRIPTION OF EXEMPLARY EMBODIMENTS

Embodiments of the invention are directed to improved installation features for recessed lights, such as downlights. For example, in some embodiments of the invention, the recessed light may include a housing that can be installed in a hollow space of a ceiling, wall, or other structure, and a lighting module having a light source and being removably attachable to the housing. The housing may include one or more improved torsion spring receivers each for accepting and holding a torsion spring coupled to the lighting module. In another embodiment of the present invention, the lighting module may include an improved flexible conduit configuration that allows a flexible conduit connected to the flexible conduit connector to lay flatter in the housing and thereby reduce the amount of plenum space required for the housing installation. In one embodiment, the improved flexible conduit connector is mounted on a surface that is angled in the direction of the flexible conduit.

The following description of exemplary embodiments refers to the attached drawings. Any spatial references herein such as, for example, "upper," "lower," "above," "below," "rear," "between," "vertical," "angular," "beneath," etc., are for the purpose of illustration only and do not limit the specific orientation or location of the described structure.

Figure 2:
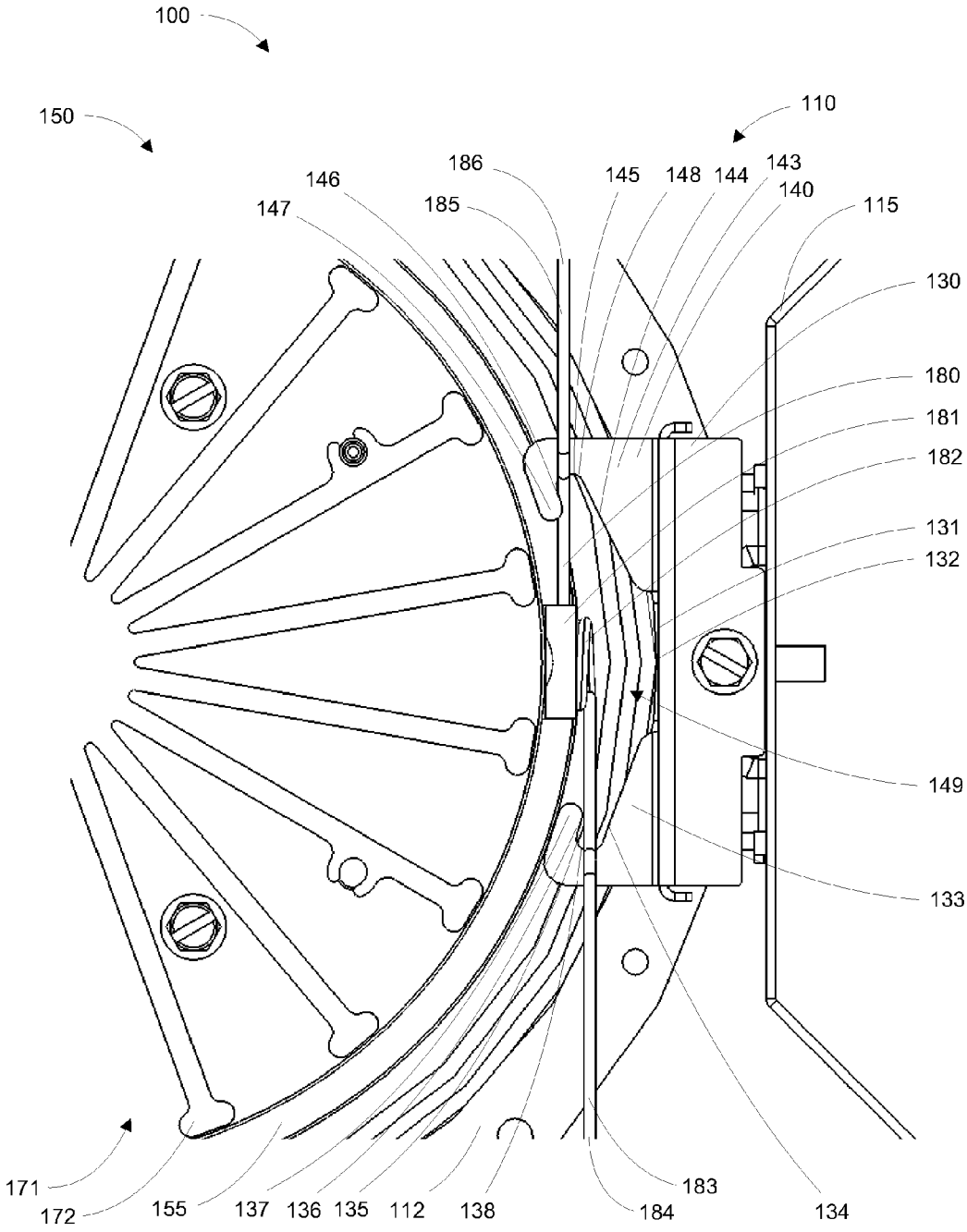
FIG. 2 is top view of a portion of the recessed light of FIG. 1, in accordance with certain exemplary embodiments.
Figure 3:
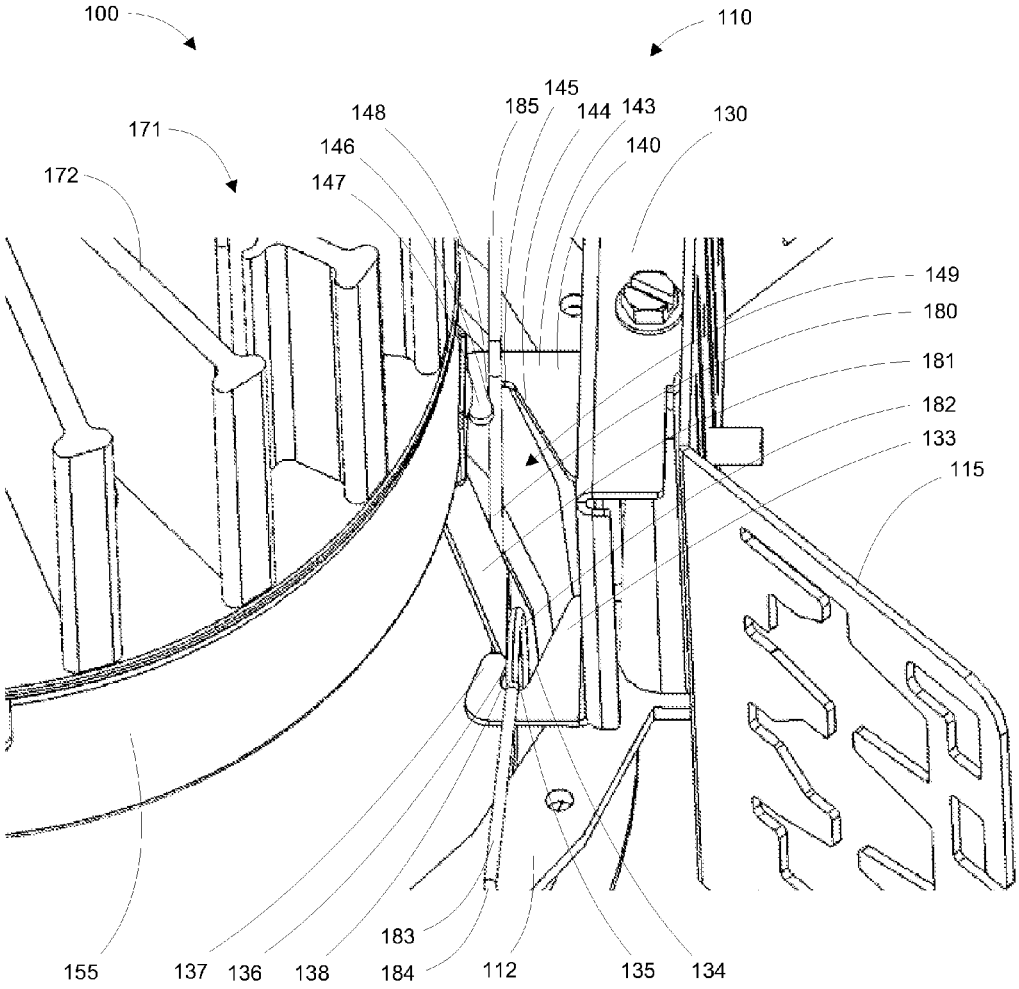
FIG. 3 is a partial perspective view of the recessed light of FIG. 1, in accordance with certain exemplary embodiments.

Referring now to the figures, in which like numerals represent like (but not necessarily identical) elements throughout the figures, exemplary embodiments of the present invention are described in detail. FIGS. 1-3 depict portions of an exemplary recessed light 100 having improved installation features, in accordance with certain exemplary embodiments. In particular, FIG. 1 is a partial perspective view of the recessed light 100; FIG. 2 is a top view of a portion of the recessed light 100; and FIG. 3 is a partial perspective view of the recessed light 100.

Referring now to FIG. 1, the exemplary recessed light 100 includes a housing 110 and a lighting module 150 removably attachable to the housing 110. The housing 110 includes a lamp holder 112 that forms an aperture for receiving the lighting module 150. The housing 110 also includes mounting brackets 130 attached to either side of the lamp holder 112. Each mounting brackets 130 is also attached to a frame 115 that can be attached to a support structure (not shown) to hold the housing 110 in place. For example, the housing 110 can be installed in a hollow space within a ceiling by attaching the frames 115 to a ceiling joist support structure. Each mounting bracket 130 also includes at least one torsion spring receiver 140 discussed in further detail in connection with FIGS. 2 and 3. In one exemplary embodiment, the housing 110 includes two torsion spring receivers 140 positioned substantially on opposite sides of the lamp holder 112.

The lighting module 150 houses a light source (not shown) and includes at least one reflector 155 that directs or controls light output by the light source. The light source includes one or more lamps, such as one or more light emitting diodes ("LEDs"), compact fluorescent lamps ("CFLs"), incandescent lamps, or high-intensity discharge ("HID") lamps, or any other light source known to one or ordinary skill in the art. The reflector 155 includes an opening (not shown) at one end and disposed in the direction of illumination. The lighting module 150 also includes an upper surface 157 above the reflector 155 and opposite the direction of illumination. In certain exemplary embodiments, the upper surface 157 is substantially planar. In certain exemplary embodiments, one or more LED's, LED die packages, or LED chip on board light sources are coupled directly to or directly adjacent to the bottom side of the upper surface 157.

The lighting module 150 also includes a conduit connector 161 and a heat sink 171 disposed on or above the upper surface 157. In one exemplary embodiment, each of the conduit connector 161 and the heat sink 171 are coupled to the top side of the upper surface 157. The heat sink 171 dissipates heat generated by the light source. The heat sink 171 is configured and sized accordingly to allow for the conduit connector 161 and for receiving a flexible conduit 165 at a desired angle while keeping the light source at its rated or preferred operating temperature. The heat sink 171 also is sized based on dispersing sufficient amount of heat based on the light source. The heat sink 171 is capable of being fabricated from aluminum or any other suitable material known to one of ordinary skill in the art. In the illustrated embodiment, the heat sink 171 includes a multitude of heat sink fins 172 extending radially from a central core extending up from the upper surface 157. Other configurations of heat sinks are also feasible without departing from the scope and spirit of the present invention.

The conduit connector 161 is disposed between two of the heat sink fins 172 and includes at least one aperture that extends from its top side 162 through to its bottom side inside the lighting module 150. This aperture provides a pathway for electrical connections from outside the lighting module 150 to access the inner portion of the lighting module 150. The flexible conduit 165 is removably attachable to the conduit connector 161 and is used to route electrical wires or cables between the lighting module 150 and another device, such as a power source. For example, in an LED light source embodiment, a power cable is routed between one or more LEDs, LED die packages, or LED chip on board modules disposed in the lighting module 150 and an LED driver 199 disposed on or within the housing 110 via the flexible conduit 165.

The conduit connector 161 is mounted on an angled surface 159 that is disposed at an angle with respect to the upper surface 157. In one embodiment, the angled surface 159 slopes downward in a lateral direction with respect to the upper surface 157. In one embodiment, the angled surface 159 slopes downward along a tangent to the perimeter of the upper surface 157. In certain exemplary embodiments, the angled surface 159 also is disposed at an angle with respect to a radial line extending from the center of the upper surface 157 to the perimeter of the upper surface 157. This angle with respect to the radial line helps route the flexible conduit 165 over the area of the torsion spring 185 and bracket 130. In one embodiment, the angled surface 159 slopes downward at a 15° angle in the lateral direction and is offset with respect to the radial line at a 13° angle. In certain exemplary embodiments, the angled surface 159 slopes downward at an acute angle (with respect to the upper surface 157) in the lateral direction and is offset with respect to the radial line at an acute angle.

In certain exemplary embodiments, the angled surface 159 slopes downward in two directions or with respect to two axes. In one example, the angled surface 159 slopes downward from the center of the upper surface 157 towards the perimeter or outer edge of the upper surface 157 and also slopes downward in a lateral direction with respect to the upper surface 157. In certain exemplary embodiments, the angled surface 159 slopes downward in one or both directions between 3-85 degrees with respect to the upper surface 157. In certain exemplary embodiments, the angled surface 159 slopes downward in one or both directions at an acute angle with respect to the upper surface 157. In certain exemplary embodiments, the angled surface 159 slopes downward in one or both directions at an obtuse angle with respect to the upper surface 157.

Although a portion of the angled surface 159 is illustrated as being recessed in the upper surface 157, other configurations are also feasible. In certain exemplary embodiments, a portion or substantially the entirety of the angled surface 159 is disposed above the upper surface 157. In one example, the angled surface 159 is disposed on a raised surface, such as a pad, disposed on or above the upper surface 157. Such a pad may include a substantially cube-shaped component with a surface having the desired angle(s) mounted thereon.

In another example, one end of the angled surface 159 extends above the upper surface 157 while an opposite end extends below the upper surface 157. To extend an end of the angled surface 159 above the upper surface 157, a wall may extend up from the upper surface 157 to support that end. To extend an end of the angled surface 159 below the upper surface 157, a wall may extend down from the upper surface 157 into the lighting module 150 to support that end. In one example, one lateral end of the angled surface 159 closer to one heat sink fin 172 extends above the upper surface 157 while an opposite end closer to a second heat sink fin 172 extends below the upper surface 157. For embodiments in which the angled surface 159 is angled downward in a lateral direction and also angled downward in a radial direction, the end of the angled surface 159 closer to the center of the upper surface 157 extends above the upper surface 157 while the end of the angled surface 159 closer to the perimeter of the upper surface 157 extends below the upper surface 159.

Several advantages are realized by disposing the conduit connector 161 on an angled surface 159 and thereby angling the conduit connector 161. First, by angling the conduit connector 161 in the direction that the flexible conduit 165 originates or approaches the conduit connector 161, the flexible conduit 165 can lay flatter than with a vertical conduit connector orientation. As the bend radius of flexible conduit 165 is typically limited, a vertical conduit connector would require the flexible conduit to extend higher above the upper surface 157 than an angled conduit connector 161 allows. For example, some flexible conduits have a bend radius of approximately 1.75 inches or 2.00 inches or larger. The flatter cable lie reduces the plenum space required for installing the recessed light 100. In addition, the flatter cable lie coupled with the conduit connector 162 being installed on the upper surface 157 rather than above the heat sink 171 allows for the recessed light 100 to be more compact for the recessed light 100 to be installed in shallower areas. This configuration also allows for the flexible conduit 165 to enter the area of the heat sink 171 laterally and below the upper edge of the heat sink 171. Thus, extra space is not required in the installation area for the flexible conduit 165 to run above the heat sink 171.

Another advantage of the angled conduit connector 161 is that the lighting module 150 is installed and removed with ease as the angle of the conduit connector 161 lends itself to direct the flexible conduit 165 to its ultimate destination when the lighting module 150 is pressed into the housing 110. As the lighting module 150 is installed in the housing 110, the angled conduit connector 161 guides the flexible conduit 165 into a lateral orientation without twisting or bending the flexible conduit in an unwanted direction.

Figure 4:
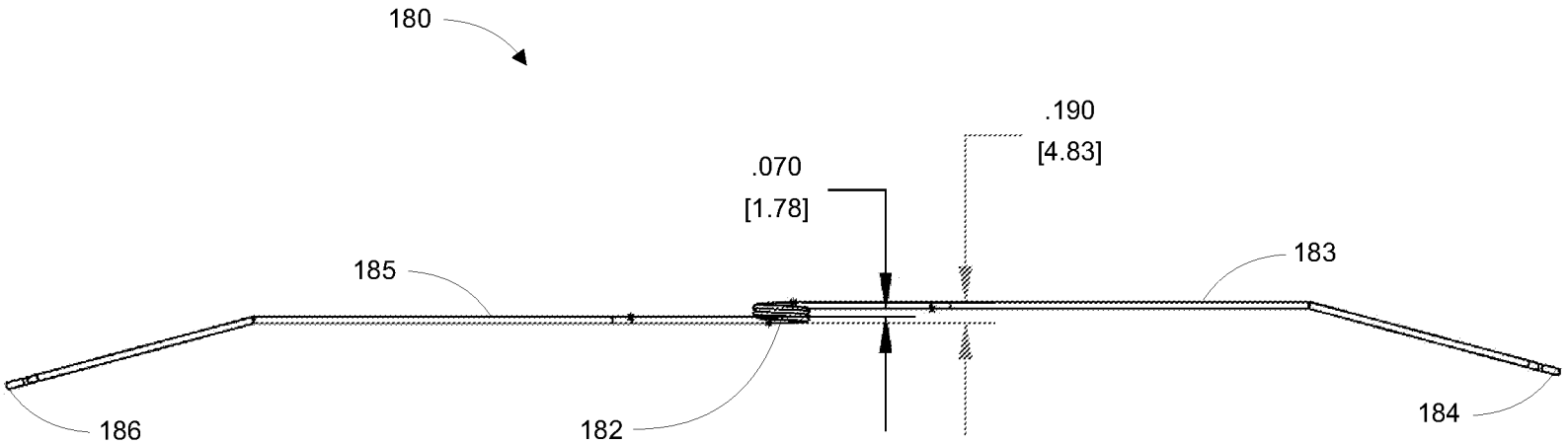
FIG. 4 depicts a torsion spring, in accordance with certain exemplary embodiments.

Turning now to FIGS. 2-4, each torsion spring receiver 140 is the attachment point between the housing 110 and a respective torsion spring 180 of the lighting module 150. Each torsion springs 180 is attached to the reflector 155 or other exterior portion of the lighting module 150 by way of a torsion spring bracket 181. The exemplary torsion springs 180 include several coils 182, a first shaft 183 extending from the coils 182 and having a first end 184, and a second shaft 185 extending from the coils 182 and having a second end 186. In general, a user can install the lighting module 150 in the housing 110 by squeezing the two ends 184, 186 of each torsion spring 180 together and inserting the ends 184, 186 into an open area 149 of the respective torsion spring receiver 140. By squeezing the two ends 184, 186 together, the coils 182 are twisted tighter resulting in a force that attempts to cause the ends 184, 186 to retract. With the shafts 183, 185 inserted into the open area 149, the user can push the lighting module 150 into the housing 110 and release the ends 184, 186. The force of the coils 182 causes the shafts 183, 185 to retract and thus, causes the shafts 183, 185 to engage hook-shaped slots 138, 148, respectively, of the torsion spring receiver 140. The torsion spring receivers 140 and the torsion springs 180 are configured so that the torsion springs 180 pulls the lighting module 150 into the housing 110 as discussed in further detail below.

The exemplary torsion spring receivers 140 include several features that improve the installation and removal of the lighting module 150 from the housing 110. As best seen in FIG. 2, the torsion spring receiver 140 includes a backstop 131 and two torsion spring receiver portions 133, 143. In certain exemplary embodiments, the backstop 131 and torsion spring receiver portions 133, 143 are fabricated as a single, integrated unit. In certain alternative embodiments, the torsion spring receiver 140 includes a first bracket having the first torsion spring receiver portion 133 and a second bracket having the second torsion spring receiver portion 143. In such an embodiment, the two brackets are coupled to the backstop 131 at opposite lateral sides.

The open area 149 is defined by an inner surface of the backstop 131 and inner edges of the torsion spring receiver portions 133, 143. In particular, the backstop 131 includes a substantially planar surface that provides a substantially straight edge 132 for the open area 149. The first torsion spring receiver portion 133 includes an edge 134 that extends from the edge 132 to a semicircle-shaped edge 135. The first torsion spring receiver portion 133 also includes a retaining tab 137 having a substantially straight edge 136 extending from the semicircle-shaped edge 135 opposite the edge 134. The edges 133-136 form the hook-shaped slot 138 for receiving and holding in place a portion of the torsion spring 180.

The edge 134 extends out orthogonally from the edge 132 and then curves to extend at an acute angle with respect to the edge 132. This angled configuration enables the edge 134 to guide the shaft 183 into the hook-shaped slot 138 during installation of the lighting module 150 with the housing 110. That is, when the shaft 183 is inserted into the open area 149 and the ends 184, 186 are released, the tension of the coils 182 causes the shaft 183 to press against the edge 134. As the shaft 183 presses against the edge 134, the edge 134 guides the shaft 183 into the hook-shaped slot 138. In certain exemplary embodiments, rather than extending out orthogonally, the edge 134 extends at the angle directly from the edge 132.

The second torsion spring receiver portion 143 includes an edge 144 that extends from the straight edge 132 to a semicircle-shaped edge 146. The second torsion spring receiver portion 143 also includes a retaining tab 147 having a substantially straight edge 146 extending from the semicircle-shaped edge 145 opposite the edge 144. The edges 143-146 form the hook-shaped slot 148 for receiving and holding in place a portion of the torsion spring 180.

The edge 144 extends out orthogonally from the edge 132 and then curves to extend at an acute angle with respect to the edge 132. This angled configuration enables the edge 144 to guide the shaft 185 into the hook-shaped slot 148 during installation of the lighting module 150 with the housing 110. That is, when the shaft 185 is inserted into the open area 149 and the ends 184, 186 are released, the tension of the coils 182 causes the shaft 185 to press against the edge 144. As the shaft 185 presses against the edge 144, the edge 144 guides the shaft 185 into the hook-shaped slot 148. In certain exemplary embodiments, rather than extending out orthogonally, the edge 144 extends at the angle directly from the edge 132. By having the edges 134, 144 angled with respect to the edge 132 as illustrated, the size of the open area 149 is increased. This larger open area 149 makes it easier for a user to insert the ends 184, 186 into the open area 149.

The retaining tabs 137, 147 and the edges 136, 146 also are positioned at an angle with respect to the straight edge 132 of the backstop 131. In particular, the retaining tabs 137, 147 are configured to point in towards the open area 149. In this configuration, the edges 136, 146 help prevent the force exerted on the shafts 183, 185 by the coils 182 from causing the torsion spring 180 to slip from the torsion spring receiver 140. If the retaining tabs 137, 147 extended in a direction substantially in parallel with the straight edge 132, the force exerted on the shafts 183, 185 by the coils 182 could more easily cause the torsion spring 180 to slip from the torsion spring receiver 140 as parallel edges would provide less resistance to this force. In certain exemplary embodiments, the retaining tabs 137, 147 and the edges 136, 146 are angled at an acute angle with respect to the edge 132.

In certain exemplary embodiments, the retaining tabs 137, 147 are configured to match or resemble the profile of the heat sink 171. That is, in certain exemplary embodiments, the retaining tabs 137, 147 are tangential to the circumference or perimeter of the heat sink 171. This configuration helps prevent the heat sink 171 from contacting or hitting the torsion spring receiver 140 during installation of the lighting module 150 with the housing 110. This configuration also supports a more compact design of the housing 110.

In certain exemplary embodiments, the torsion spring receiver 140 does not include the straight edge 132. Rather, an end of the edge 134 opposite the semicircle-shaped edge 135 contacts an end of the edge 144 opposite the semicircle-shaped edge 145 to form a v-shape.

In certain exemplary embodiments, the torsion spring receiver 140 is configured to facilitate the offset of the torsion spring 180. As best seen in FIG. 4, the shafts 183, 185 of the torsion spring 180 have an offset caused by the coils 182. In one exemplary embodiment, the offset between inner edges of the shafts 183, 185 is approximately 0.07 inches and the offset between outer edges of the shafts 183, 185 is approximately 0.19 inches. The offset of the torsion spring 180 can vary based on the number of coils 182, the diameter of the coils 182, and the thickness of the rod or wire used to form the torsion spring 180. One way of facilitating this offset includes widening the opening of one or both hook-shaped slots 138, 148. Another way to facilitate the offset includes offsetting the hook-shaped slots 138, 148 to match the offset of the torsion spring 180. In certain exemplary embodiments, one of the hook-shaped slots 136, 146 is disposed at a greater orthogonal distance from the backstop 131 than the other hook-shaped slot 138, 148 to compensate for the offset. For example, one of the edges 134, 144 can extend further from the straight edge 132 or at a different angle than the other edge 134, 144 to position the respective hook-shaped slot 138, 148 at a greater orthogonal distance from the straight edge 132 than the other hook-shaped slot 138, 148.

Figure 6:
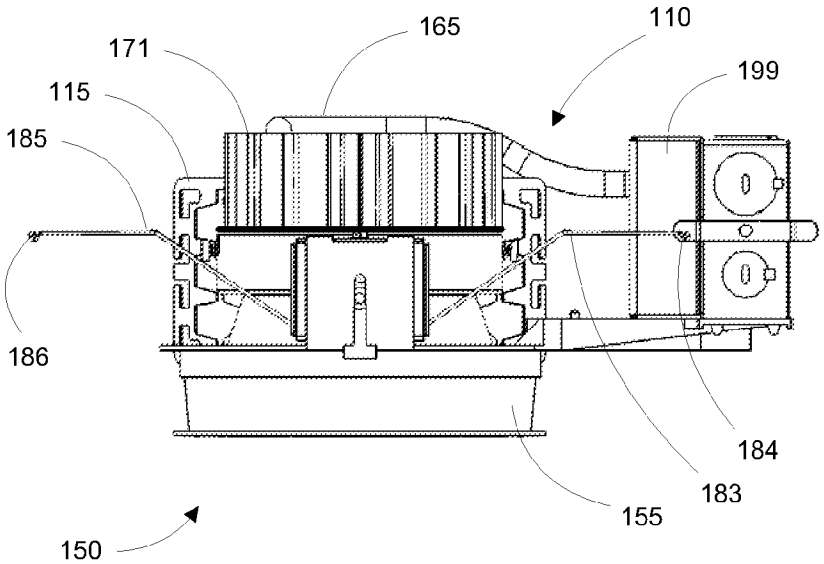
FIG. 6 is side view of the lighting module installed in the housing of FIG. 1, in accordance with certain exemplary embodiments.
Figure 5:
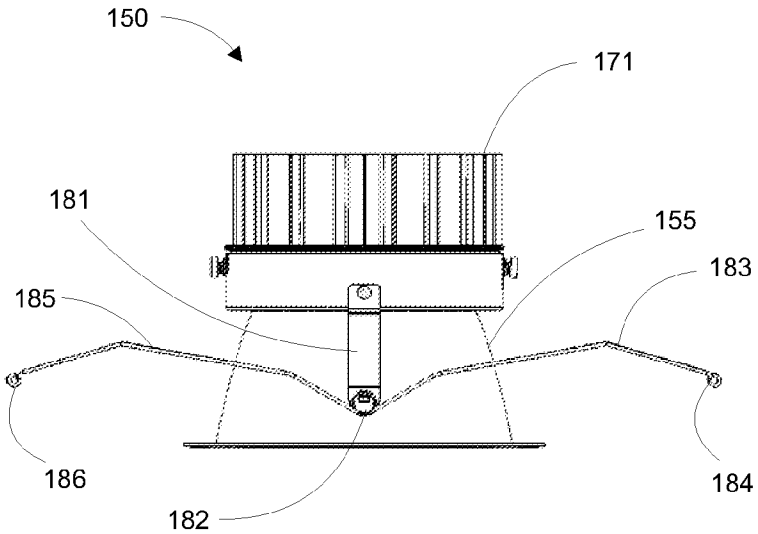
FIG. 5 is a side view of the lighting module of FIG. 1, in accordance with certain exemplary embodiments.

FIG. 5 is a side view of the lighting module 150 detached from the housing 110 and FIG. 6 is a side view of the lighting module 150 installed in the housing 110. Referring to FIGS. 1-6, a user can install the lighting module 150 in the housing 110 by holding the lighting module 150 proximal to the housing 110 and making the appropriate electrical connections. For example, the user may connect power supply wires (routed via the conduit 165) from a driver 199 to the light source. The user may route the wires through the aperture in the conduit connector 161 and make the appropriate connection to the light source. The user may attach the conduit 165 to the conduit connector 161.

With the electrical connections made, the user squeezes the ends 184, 186 of the torsion springs 180 together and inserts the ends 184, 186 into the open area 149 of the respective torsion spring receiver 180. The user can push the lighting module 150 into the housing 110 and release the ends 184, 186 into the respective torsion spring receiver 140. After being released, the tension in the coil 182 of each torsion spring 140 causes the respective shaft 183 to press against the respective edge 134 and the edge 134 guides the shaft 183 into the hook-shaped slot 138. Similarly, the respective shaft 185 presses against the respective edge 144 and the edge 144 routes the shaft 185 into the hook slot 148. The retaining tabs 137, 147 prevent the respective shafts 183, 185 from slipping from the respective hook-shaped slots 136, 146.

While the torsion spring shafts 183, 185 are routed into position in the torsion spring receiver 140, the span of the torsion spring 180 pulls the lighting module 150 into the proper position in the housing 110. That is, as the shafts 183, 185 retract and press against the edges 134, 144, the torsion spring 180 pulls the lighting module 150 upwards (for a downlight) into the housing 110. The size of the opening 149 and thus, the distance between hook-shaped slots 136, 146, is configured along with the torsion spring 140 such that the torsion spring 140 pulls the lighting module 150 into the proper position within the housing 110 without releasing the torsion spring 180 from the torsion spring receiver 140.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A lighting module, comprising:
- a first surface comprising a first side and an opposing second side;
- a light source disposed along the first side;
- a heat sink disposed on the second side and opposite a direction of illumination for the light source; and
- a flexible conduit connector disposed at an acute angle along at least one axis and disposed along the first surface, the flexible conduit connector providing an aperture through the first surface for receiving electrical wiring for the light source,
- wherein the flexible conduit connector is disposed on an angled surface, the angled surface having the acute angle and being disposed along the first surface.

2. The lighting module of claim 1, wherein the angled surface is angled at an acute angle along two axes with respect to the first surface.

3. The lighting module of claim 1, wherein the angled surface is angled in a direction from the heat sink towards the light source from a point on the angled surface proximal the center of the first surface to a point on the angled surface proximal the perimeter of the first surface.

4. The lighting module of claim 1, wherein the angled surface is angled in a lateral direction with respect to the first surface.

5. The lighting module of claim 1, wherein at least a portion of the angled surface is recessed in the first surface.

6. The lighting module of claim 1, wherein at least a portion of the flexible conduit connector is recessed in the first surface.

7. The lighting module of claim 1, wherein the heat sink comprises a plurality of heat sink fins and wherein the flexible conduit connector is disposed between two of the heat sink fins.

8. A light fixture, comprising:
- a housing for receiving and holding a lighting module comprising a light source; and
- a torsion spring receiver coupled to the housing and comprising:
  - a backstop comprising a substantially straight edge;
  - a first torsion spring bracket disposed on a first side of the backstop for receiving a first portion of a torsion spring, the first torsion spring bracket comprising:
    - a first inner edge extending out orthogonally from the straight edge and curving to extend further from the straight edge at a first acute angle with respect to the straight edge; and
    - a first retaining tab comprising a first curved edge that extends from the end of the first inner edge opposite the straight edge to form a first area for receiving the first portion; and
  - a second torsion spring bracket disposed on the first side of the backstop for receiving a second portion of the torsion spring, the second torsion spring bracket comprising:
    - a second inner edge extending out orthogonally from the straight edge and curving to extend further from the straight edge at a second acute angle with respect to the straight edge; and
    - a second retaining tab comprising a second curved edge that extends from the end of the second inner edge opposite the straight edge to form a second area for receiving the second portion.

9. The light fixture of claim 8, wherein the first retaining tab is positioned at a greater distance orthogonally from the backstop than the second retaining tab.

10. The light fixture of claim 8, wherein the first curved edge comprises a larger radius of curvature than the second curved edge.

11. The light fixture of claim 8, wherein the first angle and the second angle are substantially the same.

12. The light fixture of claim 8, wherein the first angle and the second angle are substantially different.

13. A downlight luminaire, comprising:
- a housing for receiving and holding a lighting module comprising a light source; and
- at least one torsion spring receiver coupled to the housing, each torsion spring receiver comprising:
  - a backstop comprising a substantially straight edge;
  - a first torsion spring receiver portion disposed on a first side of the backstop and comprising a first edge that extends at a first acute angle from the straight edge to a first inner hook-shaped edge, the first torsion spring receiver portion for receiving a first portion of a torsion spring of the lighting module; and
  - a second torsion spring receiver portion disposed on the first side and comprising a second edge that extends at a second acute angle from the straight edge to a second inner hook-shaped edge, the second torsion spring receiver portion for receiving a second portion of the torsion spring.

14. The downlight luminaire of claim 13, wherein the lighting module comprises a heat sink comprising a plurality of heat sink fins extending radially from an axis substantially orthogonal to an upper surface of the lighting module, and wherein the first inner hook-shaped edge and the second inner hook-shaped edge each comprise an edge that is tangential to the perimeter of the heat sink.

15. The downlight luminaire of claim 13, wherein the first inner hook-shaped edge is positioned at a greater distance orthogonally from the backstop than the second inner hook-shaped edge.

16. The downlight luminaire of claim 13, wherein the first inner hook-shaped edge comprises a larger radius of curvature than the second inner hook-shaped edge.

17. A light fixture, comprising:

a housing for receiving and holding a lighting module comprising a light source; and at least one torsion spring receiver coupled to the housing, each torsion spring receiver comprising:

a backstop comprising a substantially straight edge;

a first torsion spring receiver portion disposed on a first side of the backstop and comprising a first edge that extends from the substantially straight edge to a first inner hook-shaped edge, the first torsion spring receiver portion for receiving a first portion of a torsion spring of the lighting module; and a second torsion spring receiver portion disposed on the first side and comprising a second edge that extends from the substantially straight edge to a second inner hook-shaped edge, the second torsion spring receiver portion for receiving a second portion of the torsion spring, wherein the first inner hook-shaped edge is positioned at a greater distance orthogonally from the substantially straight edge than the second inner hook-shaped edge.

18. The light fixture of claim 17, wherein the first edge extends from the substantially straight edge at a first acute angle with respect to the substantially straight edge and wherein the second edge extends from the substantially straight edge at a second acute angle with respect to the substantially straight edge.

19. The light fixture of claim 17, wherein the first inner hook-shaped edge comprises a larger radius of curvature than the second inner hook-shaped edge.

* * * * *